US007033288B1

(12) United States Patent
Edwards et al.

(10) Patent No.: US 7,033,288 B1
(45) Date of Patent: Apr. 25, 2006

(54) TOOL AND METHOD FOR GOLF GREEN MAINTENANCE

(76) Inventors: Richard D. Edwards, 9933 E. Happy Valley Rd., Scottsdale, AZ (US) 85255; Terry Wiens, 4587 217 B Street, Langley, British Columbia (CA) V3A 2N9

( * ) Notice: Subject to any disclaimer, the term of this patent is extended or adjusted under 35 U.S.C. 154(b) by 0 days.

(21) Appl. No.: 10/785,245

(22) Filed: Feb. 23, 2004

Related U.S. Application Data

(60) Provisional application No. 60/449,257, filed on Feb. 21, 2003.

(51) Int. Cl.
*A63B 57/00* (2006.01)

(52) U.S. Cl. ..... 473/408

(58) Field of Classification Search ..... 473/408, 473/286, 386; 294/19.1, 51, 52; 30/113.1, 30/113

See application file for complete search history.

(56) References Cited

U.S. PATENT DOCUMENTS 474,697 A * 5/1892 Shimer ..... 294/51
823,571 A * 6/1906 Whitehead ..... 294/51
1,573,539 A * 2/1926 Brown ..... 294/19.1
2,465,024 A * 3/1949 Ludt ..... 294/19.1
3,049,182 A 8/1962 Pelow
3,242,513 A * 3/1966 Janke ..... 294/51
3,539,017 A 11/1970 Johnson
3,774,913 A 11/1973 Dien
4,951,951 A 8/1990 Meyer
4,955,609 A 9/1990 Kassen
5,165,744 A * 11/1992 Vogrin ..... 473/386
5,209,469 A 5/1993 Laskowitz et al.
5,306,000 A * 4/1994 Comella ..... 473/386
5,405,133 A 4/1995 Upton
5,437,449 A 8/1995 Zink
5,511,785 A 4/1996 Rusin
6,223,829 B1 5/2001 Wiens

* cited by examiner

*Primary Examiner*—Steven Wong
(74) *Attorney, Agent, or Firm*—Michael F. Hughes; Hughes Law Firm, PLLC

(57) ABSTRACT

A multipurpose tool assembly to perform a divot repair operation, a coring operation and/or a green surface smoothing operation on a golf green. There is an elongate operating section having on one end a divot repair tool portion and on the other end a coring tool portion. The operating section can be connected to the handle in either of two configurations to perform either the divot repair operation or the coring operation.

15 Claims, 3 Drawing Sheets

TOOL AND METHOD FOR GOLF GREEN MAINTENANCE

RELATED APPLICATIONS

This application claims priority benefit of U.S. Ser. No. 60/449,257 filed Feb. 21, 2003.

BACKGROUND OF THE INVENTION a) Field of the Invention

The present invention relates to golf course maintenance, especially golf greens, and more particularly providing a tool which can conveniently be used to repair divots and other damaged portions of the golf green.

b) Background Art

One of the problems in maintaining a smooth surface on golf greens is the formation of divots that can be made when a golf ball impacts the surface of the green. In such cases, the impact of the golf ball forms the indentation and also displaces the underlying ground material and sod layer laterally and downwardly. To repair such divots, there has been devised a tool which is described in U.S. Pat. No. 6,233,829 B1. This tool comprises an elongate member, which in one embodiment is a shaft of a golf club, with a golf green repair member at the end face of the handle of the golf club. The tool comprises a fork member extending upwardly from the handle of the golf club. To repair the divot, the golf club is inverted and the fork member is pressed into the ground at the location of the divot an adjacent compression surface engages the surround raised surface and reposition the underlying displaced ground, and also move the sod cover back toward its original position.

Another defect in the golf green requiring maintenance is where there is a small patch of dead or deformed grass cover (or absence of the same) or a soft spot where the ground material has been either displaced or somehow deformed. These are commonly repaired by the use of the coring tool where a cylindrical cutting edge having a central recess is pushed into the ground at the location of the defect, with the sod and/or ground material at the defect location entering up into the recess of the coring tool. Then, the sod and/or ground material that ha accumulated in the coring tool can be removed in some manner.

Also, when these tasks (as noted immediately above) are performed, it then becomes necessary to smooth out the green surface in the area of the repair.

The embodiment of the present invention is designed to provide a convenient method and tool to accomplish these tasks more effectively.

BRIEF DESCRIPTION OF THE DRAWINGS

FIG. 1B is an elevational view similar to 1A except with the operating section being viewed from a position spaced ninety degrees from the position at which FIG. 1A is being viewed;

FIG. 2B is an elevational view of the handle section but taken from a location spaced 90 degrees from the location at which FIG. 2A is taken;

DETAILED DESCRIPTION OF THE PREFERRED EMBODIMENTS

Figure 3:
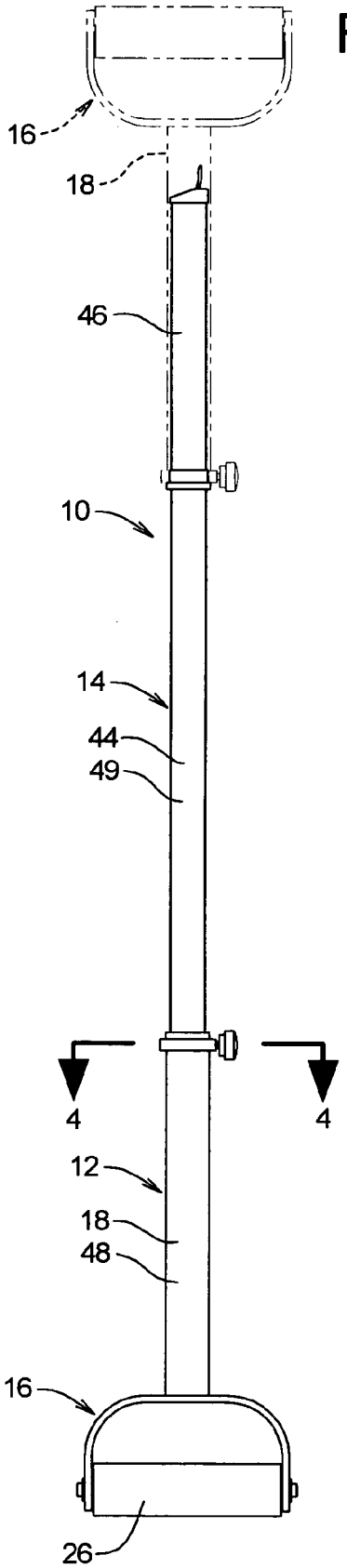
FIG. 3 is a side elevational view similar to FIG. 1A, except that the handle section is shown in full lines being connected to one end portion of the operating section, and being shown in broken lines connected to a second end portion of the operating section.

The apparatus of the present invention is in the form of a tool assembly 10 which has two main components, namely a handle section 12, and an operating section 14. In FIG. 3, these two components 12 and 14 are shown in engagement with one another in one of the operating configurations of the tool assembly 10 with the handle section 12 being shown in solid lines, and shown in a second operating configuration in which the handle section is shown in broken lines in FIG. 3.

In this embodiment, the tool assembly has an elongate straight line configuration and a generally circular cross section configuration along its length. For purposes of description, the assembly shall be considered as having a longitudinal axis 15 which extends along a center line of the entire tool assembly.

The handle section 12 comprises a handle portion 16 and a longitudinally extending shaft 18 connected thereto. The handle portion 16 in turn comprises a U-shaped mounting member 20 having a base 22 and a pair of arms 24. The base 22 is connected at its mid-portion to the upper end of the shaft 18.

With reference to FIG. 3, it can be seen that the handle portion 16 comprises a handle grip 26 which has a cylindrical configuration which can easily be gripped in a person's hand. This handle grip 26 is positioned between the outer ends of the arms 24 of the mounting member 20 by means of a bolt 28 or other elongate mounting member, and the handle grip 26 is rotatably mounted around the bolt. As will be described more completely later herein, this handle grip 26 serves also the function of being a compression roller to smooth out the surface of the green in the area of a maintenance operation.

The shaft 18 has a handle engaging rear end portion 30 and an outer end portion 32 that functions as a connect/disconnect end portion 30. The end portion 30 is fixedly connected to the base 22 of the mounting member 20, as described above. There is at the outer end portion 32 of the shaft 18 an outwardly facing end opening 34 which leads into an interior cylindrical passageway or socket 36 which extends through of the shaft 18. At the outer end of the shaft 18, there is a locking portion 38. As shown in FIG. 2C, this locking portion 38 comprises a set screw and a recess 42, and the manner in which these cooperate to make the connection with operating section 14 will be described later herein.

The operating section 14 comprises an elongate operating extension member 44 having first and second operating end portions 46 and 48 respectively, and a center section 49. As shown herein, the extension member 44 is made as an elongate cylindrical tubular member of uniform inside and outside diameter, and extending the entire length of the operating section 14. The first operating end portion 46 comprises a green divot repair portion 50, and the second operating end portion 48 comprises a coring tool portion 52.

The extension member 44 has an outer cylindrical surface 54 having an outer diameter sized to fit snugly within the interior passageway 36 in the shaft 18. Also, both the green divot repair tool portion 50 and the coring tool portion 52 have a maximum lateral dimension which is sufficiently small so as to be able to fit within the passageway 36 of the shaft 18.

To describe the green divot repair tool portion 50, reference is made to FIGS. 1A, 1B, 3, and 5.

The green divot repair tool portion 50 comprises a circular end mounting portion 54 which has a main flat end compression surface 56 which makes an angle (indicated at 58) with the longitudinal axis 19 of between fifteen degrees and thirty degrees, in a narrower range between twenty and twenty-five degrees. There is an end surface portion 59 that is immediately adjacent to the main compression surface portion 56 and perpendicular to the longitudinal axis 15. There is a fork portion 60 extending outwardly from a location at which the two surfaces 56 and 59 join parallel to the longitudinal axis 15. As shown here, in the fork portion 60 has two substantially planar fork members 62 which lie in the same plane which is generally to the longitudinal axis 19. These two fork members 62 are spaced a short distance from each other.

Figure 1A:
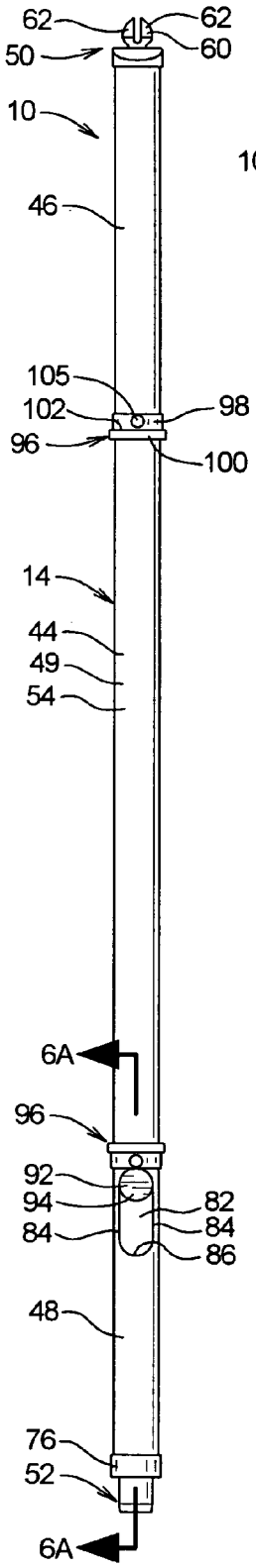
FIG. 1A is an elevational view looking at a side portion of an operating section of the tool assembly of this embodiment of the present invention.
Figure 1B:
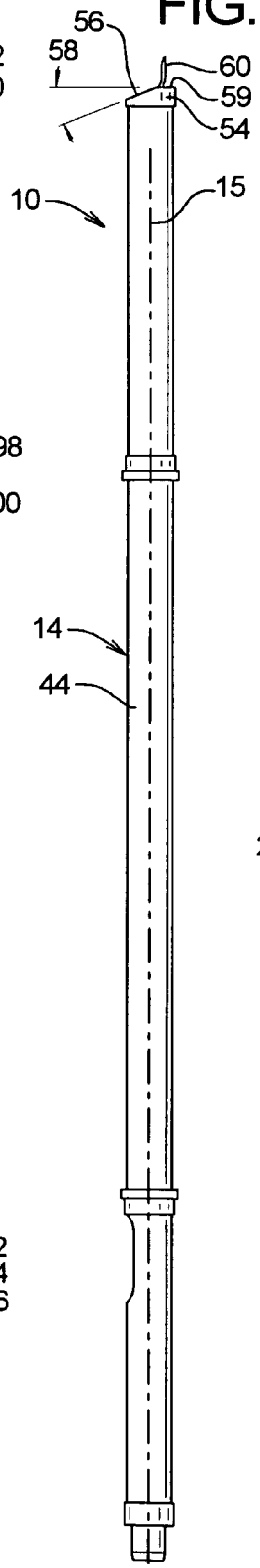
Figure 2A:
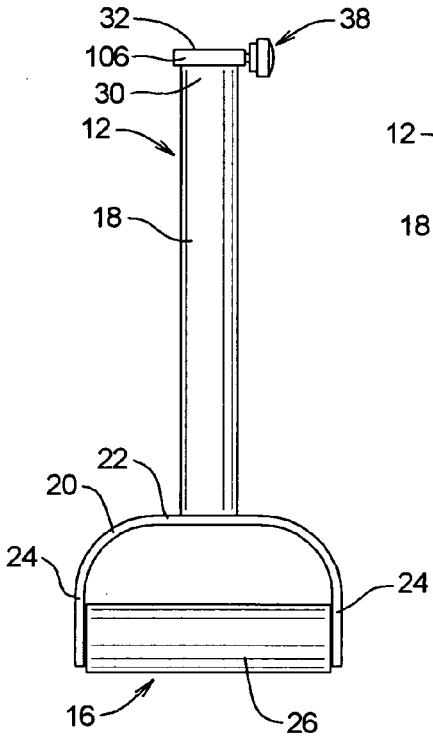
FIG. 2A is an elevational view of a handle section of this embodiment.
Figure 2B:
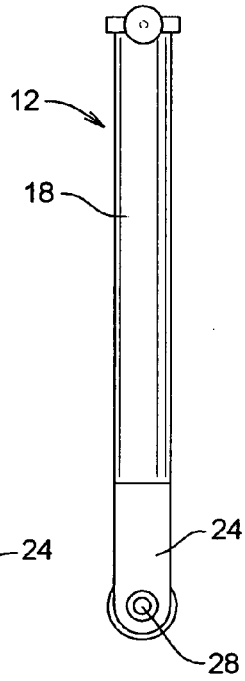
Figure 2C:
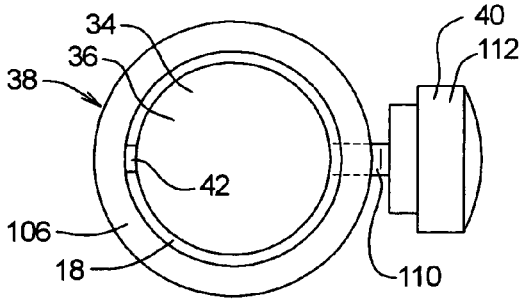
FIG. 2C is an end view taken from a location which is at the upper end of the handle section as shown in FIG. 2A.

In FIG. 2, there is shown the tool assembly 10 in full lines in its assembled position in a first configuration where the second operating end portion 48 with the coring tool portion 52 has been inserted into the recess 36 of the shaft 18 of the handle section 12, and with the first operating end portion 46 with its green divot repair tool portion 50 extending outwardly from the first end portion 46 of the extension member 44. (The handle section 12 is shown in broken lines in its second configuration, and this will be described later).

Figure 5:
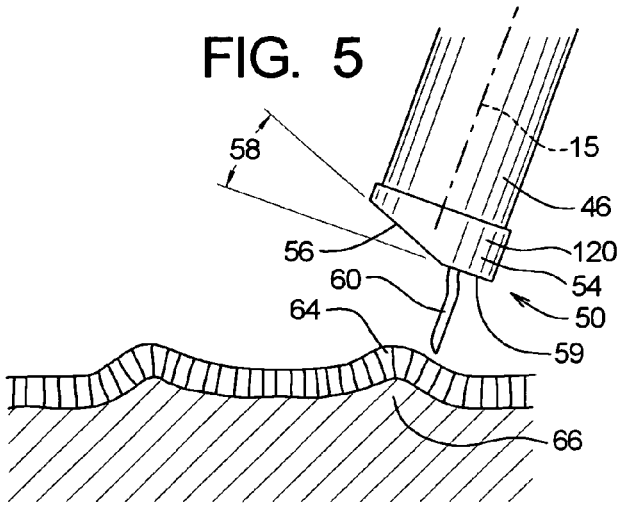
FIG. 5 is a side elevational view showing a cross section of the golf green sod and the underlying ground in cross section, and showing the green divot repair portion of the present invention in a position which begins the operation of this green divot repair portion.

In FIG. 5, the green divot repair tool portion 50 is shown in its operating position in which it is being moved downwardly so that the fork 60 would penetrate into the green surface and enable the compression surface 58 to properly engage the raised ridge 64 of the divot to move the raised green surface portion downwardly and displace the underlying ground material 66. After this is accomplished, then the tool can be moved to other portions of the raised ridge portion 64 of the divot to press the sod portion into place.

Figure 6A:
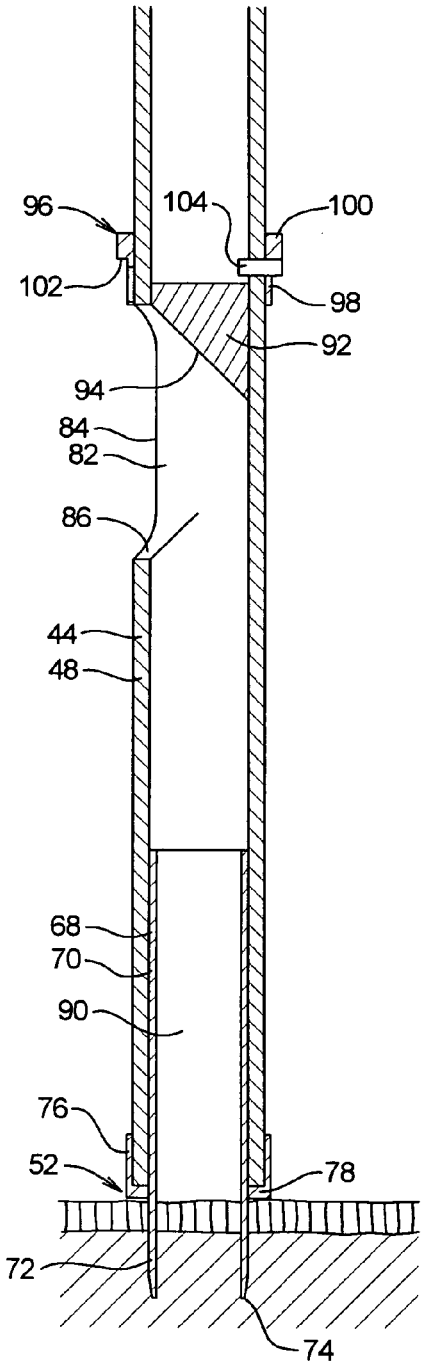
FIG. 6A is a sectional view taken along line 6A—6A illustrating the coring tool portion of the embodiment shown in its operating position where it is engaging a core of the sod and underlying ground of the golf green.
Figure 6B:
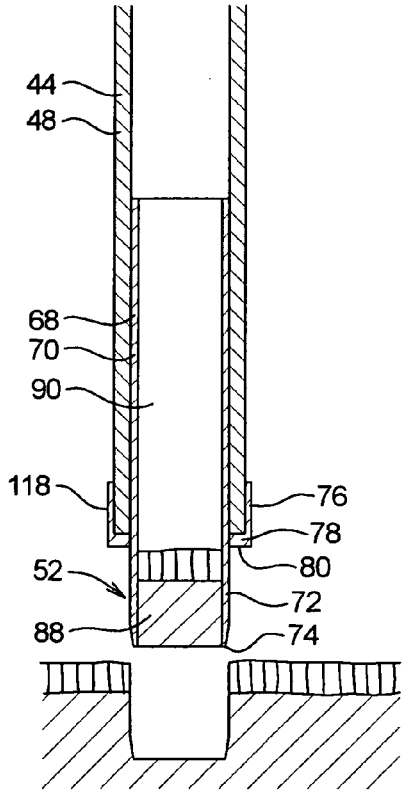
FIG. 6B is a cross section view similar to FIG. 6A and showing the coring tool portion lifting a core of sod and the underlying ground material from the golf green.

The coring tool portion 52 can best be seen in FIGS. 6A and 6B. The basic structure of the coring tool portion 52 is a thin metal cylindrical tube 68 which has a mounting portion 70 positioned in the adjacent end portion of the extension member 44, and operating portion 72 that extends outwardly from the end of the extension member 44 to a length of about three quarters of an inch. The outermost circular edge 74 of the coring tool portion 52 is made as a sharp edge so it can dig through the sod surface of the green and into the underlying ground layer. There is a provided an end cap 76 having a cylindrical portion enclosing the lowermost end of the extension member 44 and also having a inturned annular shoulder 78 that fits over the adjacent end edge of the extension member 44. This shoulder 78 has a exposed surface 80 that forms a shoulder lying in a plane perpendicular to the longitudinal axis 19. This surface 80 functions as a locating surface.

At a location about six inches above the cutting edge 74, the extension member 44 is formed with a cutout 82 that is about two inches in length and is parallel to the longitudinal axis 15. This cutout 82 has a race track configuration with two side edges 84 and two 180 degree end edges 86. The cut out is formed as a little bit less then 180 degrees of the circumference of the extension member 44.

The operation of the coring tool portion can best be described with reference to FIGS. 6A and 6B. The cutting edge 74 of the coring tool portion 52 is placed at the surface of that portion of the green surface that is defective and pressed through the sod and then into the underlying layer as shown in FIG. 6A to cut out a core from the sod and the underlying ground. The shoulder surface 80 can function as a locating surface to limit the downward travel of the coring portion to the appropriate depth. With that being accomplished, the tool is lifted from the golf green and the core 88 remains lodged in the tool portion 72.

It is possible that several successive coring operations could be performed and that several cores (of the sod and the underlying soil) are simply pushed up further into the chamber 90 that is defined by the tubular member 68 and the adjacent portion of the extension member 44. To remove the cores 88 from the chamber 90, a tool could be used by inserting it into the end opening of the coring tool 52 and/or by also inserting the tool through the access opening in the form of the cutout 82.

Also, the upper end of the cutout 82 there is a plug member 92 having a slanting outwardly facing surface 94 that slants, as seen in FIG. 6A, upwardly toward the top of the cutout opening 82. As the cores 82 (i.e. the sod and the underlying ground portions) moves up the chamber 90, these would be diverted laterally by contacting the surface 94.

Figure 4:
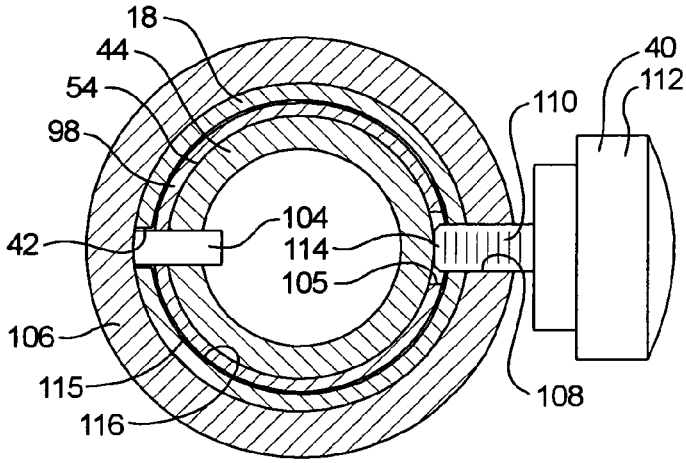
FIG. 4 is a cross sectional view taken at line 4—4 for FIG. 3, and illustrating a locking and positioning portion at a locking location of the handle section and the operating section.

Earlier in this text it was indicated with reference to FIG. 4 that the handle section had a locking portion 38 comprising a set screw 40 and a recess 42. To explain this further, it was indicated earlier that the extension member 44 had first and second operating end portions 46 and 48 and a center section 49. Each of the first and second end portions 46 and 48 has at its juncture location with the central portion 49 a positioning and locking member 96 which is in the form of a collar that surrounds, and is bonded to, the extension member 44. This positioning and locking member 96 comprises a sleeve portion 98 having an outer surface of a smaller diameter, and a positioning ring portion 100 made integrally with the sleeve portion 98 and having a moderately larger outside diameter. Thus, the positioning ring 100 provides an annular positioning surface 102 in the form of a shoulder which lies in a plane perpendicular to the longitudinal axis 15. The positioning and locking member 96 further comprises a radially extending positioning pin 104 (see FIG. 4) which extends through the shaft 44 and also through the sleeve portion 98 to extend a short distance beyond the sleeve portion 98 be able to engage the aforementioned recess 42 formed in the shaft 18 of the handle section 12. Also, the sleeve portion 98 has a positioning side opening or recess 105 which receives an engaging end of the set screw 40.

The aforementioned locking portion 38 of the handle section 12 is in the form of a locking collar 106 that is bonded to the end edge portion of the shaft 18. This collar 106 has a threaded side opening 108 to receive the screw portion 102 of the set screw 40. The head 112 of the set screw 40 is outside of the collar 106. The radially inwardly end portion 114 of the screw portion 110 may be configured to function as a retaining member so that the threaded screw portion 110 is retained in the threaded opening 108 in the collar 106.

The outer surface 115 of the sleeve portion 98 of each positioning and locking member 96 is sized so as to fit snuggly within the inner surface 116 of the shaft 18 of the handle section 12. In like manner, the outer surface 118 of the end cap 76 at the coring tool portion 72 is sized to fit snugly within the inner surface 116 of the shaft 18, and the outer surface 120 of the mounting portion 56 of the green divot repair portion 48 also is dimensioned to fit snugly in the inner surface 116 of the shaft 18. Thus, when either end portion 46 or 48 or the extension member 44 is inserted into the elongate passageway (socket) 36 of the shaft 18 of the handle portion 12, it is in close engagement with the inner surface 16 of this passageway (socket) 36 of the shaft 18. Likewise, the outer surface 118 of the end cap 76 of the coring tool portion 52 and also the outer surface 120 of the green divot repair portion 48 fit snugly within the inner surface 116. Thus, each of the end portions 46 and 48 are firming engaged by their opposite end portions so as to be in firm engagement so that the tool assembly 10 in its operating positions is formed as one rigid tool.

Also, it will be noted that the recess 42 formed in the shaft 18 of the handle section 12 is positioned as to be diametrically opposite to the location of the threaded portion 112 of the set screw 40. Also, the locating pin 104 of each of the positioning and locking members 96 is positioned so as to be diametrically opposed to the positioning side opening 105. Thus, when either end portion of the operating section 14 is inserted into the handle section 12, the positioning pin 104 slides into alignment with, and then into engagement, with the aforementioned recess 42 in the shaft 18 of the handle section 12, and this places the screw portion 110 and the set screw 40 in alignment with the side opening 105 in the sleeve portion 98 of the positioning and locking member 96. Thus, the operating section 14 and the handle section 12 come into engagement in a manner so as to be in proper alignment so that there is engagement of both the set screw 40 and the positioning pin 104.

One benefit is that when the tool assembly 10 is in the operating position of FIG. 3, the alignment of the handle grip 26 is at right angles to the plane occupied by the fork portions 62 of the fork member 60. Thus, the handle section 12 is in proper alignment so that the operation of the green divot repair portion 48, as seen in FIG. 5, is facilitated since the person's hand and wrist are properly positioned to control the positioning of the fork member 60 relative to the ridge 64 of the divot.

To describe the operation of the present invention, as indicated previously, the operating section has the extension member 44, which is a tubular cylindrical member having the two end portions 46 and 48. If there is a divot in the green which needs to be repaired, then the coring tool portion 52 is inserted into the shaft 18 of the handle section 12.

As the end cap 76 of the coring tool portion 52 moves into the open end portion of the shaft 18 of the handle section 12, the operating section 14 and the handle section 12 are in alignment with each other. When the second end portion 48 of the extension member 44 is nearly all the way into the shaft 18 of the handle section 12, the extension section 14 and the handle section 12 are rotated relative to each other so that the positioning members come into proper alignment, as described previously in this text. When these components are in proper alignment as shown in FIG. 4 (i.e. the screw portion 110 being positioned at the location of the opening 105, and the positioning pin 104 being positioned within the recess 42), the set screw 40 is rotated so that the end portion 114 of the screw 110 is securely positioned within the recess 105 and bearing against the side surface of the extension member 44.

Then the tool assembly, made up of the handle section 12 and the operating section 14, is operated as a unitary tool, and the divot repair operation is performed essentially as illustrated in FIG. 5.

After the divot area is restored to its original position, then the tool assembly 10 is inverted and the handle grip/roller member 26 is operated as a roller and rolled over the gren surface to flatten and smooth out the contour of the green surface.

When a coring operation is to take place at a location where there is a defect in the green surface which requires coring, the first operating end portion 46, having the divot repair tool portion 50, is inserted into the passageway 36 of the shaft 18, and locked in places as described above, so that the coring tool portion 52 is positioned furthest from the handle grip/roller 26. Then, again, the tool assembly 10 is operated as a unitary tool and the coring operation is accomplished by pressing the cutting edge 74 of the tool portion 52 into the ground to cause the ground material to move into the recess of the coring tool as described above. At a later time, the material can be removed. After the operation of the coring tool has been accomplished, then fill material can be placed in the recess made in the green surface, and the handgrip roller 26 can be used to smooth out the green surface of that area.

To summarize, it can be seen that in the single tool assembly, the three functions of divot repair, coring removal repair, and rolling out of the surface are all performed by a single tool.

In this embodiment, the components are sized so that these can be operated by a person of average height. In this particular embodiment, the operating section 14 has a total length of about three feet, in this particular embodiment a little less than three feet (i.e. thirty-four inches). The total length of the first end portion 46 of the extension member 44 is (including the length of the green divot repair portion 48) is between about nine and ten inches, and the length of the fork member 60 measured from the surface portion 59 is about between one half to three quarters of an inch, (and in this embodiment about five-eighths of an inch).

The total length of the second end portion 48 of the extension member 44 is a small amount great than eight inches, including the coring tool end portion 52. The total length of the coring tool portion 52 measured from the end edge 74 to the contact surface eighty is about three-quarters of an inch. The maximum length of the tool assembly in first operating position for operation of the green divot repair portion 50 is about forty inches, and is about an inch or two shorter than that for the tool assembly 12 operating as a coring tool, with the coring tool portion 58 in its operating position. Obviously these dimensions could be modified. The total length of the tool assembly 10 when operating to repair the divots could be one to three inches longer than the configuration in its core removal operation, since in repairing the divot the tool assembly 10 is operated at a moderate slant relative to the vertical. It is desirable that chamber 90 of the coring tool portion 52 have a lengthwise dimension of four, five, six, seven or eight inches, or possibly longer, to have fewer pauses to remove the cores 88.

So that there can be uniformity in the operation of the tool assembly 10 in either of its two configurations, the length of the first end portion 46 of the extension member 44 (i.e. that portion having the green divot repair portion 50) should at least nearly match the length of the coring tool portion 42 so that the overall length of the tool assembly 10 would be the same or nearly the same except for possibly extending it for use as the green divot repair operating position. This relationship would also dictate the length of the shaft 18 of the handle section 12 so that the positioning and locking members 96 would be properly positioned relative to the locking portion 38 of the handle section 12.

It is to be recognized, of course, that various modifications could be made and be within the broader scope of the present invention, for example in the arrangement of the locking portion 38 and the two positioning and locking member 96. In the present configuration, there are protrusion/recess positioning components and also recess and engaging member in the form of the positioning side opening 105 and set screw 40. There are advantages in the particular arrangement described herein, relative to ease of assembly and manufacture, reliability, compactness, and other features.

However, within the broader scope of the present invention, it is to be recognized that there are various mechanical devices to position and secure components that are placed in end to end relationship, and since these are well known to those skilled in the art, these will not be described herein. Further, the tubular configuration of the components in a cylindrical manner could within the broader scope of the present invention be modified, for example, in various cross sectional configurations.

The scope of the present invention is to be interpreted in the language of the claims, and are not intended to be limited to specific terminology in the text of the present application.

We claim:

1. A multi-purpose tool assembly adapted to repair golf greens, said tool assembly comprising:

a) a handle section having a handle grip portion and a connecting portion;

b) an elongate operating section comprising a first end portion having a green divot repair portion and a second end portion having a coring tool portion;

c) said operating section having a first operating position in which the second end portion of the operating section is connected to the connecting portion of the handle section and the first end portion of the operating section is spaced from the handle section with its green divot repair portion positioned to perform a green divot repair operation, said operating tool having a second operating position in which the first end portion of the operating section is connected to the connecting portion of the handle section and the second portion of the operating section is spaced from the handle section with the coring tool portion positioned to perform a coring operation;

d) said green divot repair portion having a substantially flat end compression surface portion which, in the first operating position, is facing downwardly to engage a green surface and a fork portion extending downwardly from the compression surface to penetrate into the green surface as the end compression surface portion is coming into contact with the green surface;

e) said coring tool portion comprising a generally cylindrically shaped and substantially tubular member having a generally circularly shaped end edge portion which in the second operating position, is positioned to dig into a sod surface of the green.

2. The tool assembly as recited in claim 1, wherein each of said first and second end portions of the operating section are arranged to be connected to the connecting portion of the handle section in telescoping relationship.

3. The tool assembly as recited in claim 2, wherein the connecting portion of the handle section has a handle section recess having an interior cross sectional configuration, such that the first end portion of the operating section with its divot repair portion fits within the handle section recess in the second operating position, and said second end portion of the operating section with its coring tool portion fits within the handle section recess in the first operating position.

4. A multi-purpose tool assembly adapted to repair golf greens, said tool assembly comprising:

a) a handle section comprising a handle grip portion and a shaft connecting portion having an elongate handle section recess;

b) an elongate operating section comprising an elongate extension member having first and second end portions positioned at opposite ends of the extension member, said first end portion having a divot repair portion and said second end portion having a coring tool portion;

c) said operating section having a first operating position in which the second end portion of the extension member, with its coring tool portion fits within said handle section recess, and said first end portion of the extension member with its divot repair portion being positioned in a first operating position to accomplish its divot repair function, said elongate extension member having a second operating position in which the first end portion of the extension member with its divot repair portion, being positioned within the handle section recess, and the second end portion of the extension member with its coring tool portion is positioned in the second operating position to perform its coring operation;

d) said green divot repair portion having a substantially flat end compression surface portion which, in the first operating position, is facing downwardly to engage a green surface and a fork portion extending downwardly from the compression surface to penetrate into the green surface as the end compression surface portion is coming into contact with the green surface;

e) said coring tool portion comprising a generally cylindrically shaped and substantially tubular member having a generally circularly shaped end edge portion which in the second operating position, is positioned to dig into a sod surface of the green.

5. The tool assembly as recited in claim 4, wherein each of the first and second end portions of the extension member fit in telescoping fashion in the handle section recess, said connecting shaft portion having a shaft locking portion, each of said first and second end portions of the extension member having an extension member locking portion adapted to engage the shaft locking portion in locking relationship.

6. The tool assembly as recited in claim 5, wherein the shaft locking portions and the extension member locking portions interfit in protrusion/recess engagement.

7. The tool assembly as recited in claim 6, wherein said locking portions are arranged with a positioning function to resist rotational movement of the extension member relative to the shaft connecting portion in a manner that there is a protrusion slot positioning configuration of said locking portions.

8. The tool assembly as recited in claim 5, wherein said shaft connecting portion has a first end portion connecting to the handle grip portion and a second opposite end portion, the shaft locking portion being positioned at the second end portion of the shaft connecting portion, and each of said locking portions of the first and second end portions of the extension member are positioned along a longitudinal axis of the extension member spaced from an outer end edge portion of the first or second end portion, so that when either of the first and second end portions of the extension member is inserted into the handle section recess, a substantial portion of the first or second end portion of the extension member is positioned within the handle section recess.

9. The tool assembly as recited in claim 8, wherein said locking portions comprise a protrusion slot arrangement to locate either the first or second portion of the extension member relative to rotation about a longitudinal axis of the extension member, and said locking portion comprises a protrusion and recess arrangement to limit movement of the first or second end portion of the extension member from movement parallel to said longitudinal axis.

10. The tool assembly as recited in claim 4, wherein each of the first and second portions of the extension member are positioned so that each of these extend into a substantial portion of the handle section recess in telescoping relationship, and there is a locking portion to retain the first or second portions of the extension member in the handle section recess, said second section of the extension member having an interior chamber extending along a longitudinal axis of said extension member so that cores of a ground surface that are cut by the coring tool portion are able to move successively upward into said chamber.

11. The tool assembly as recited in claim 10, wherein said second portion of the extension member has an access opening therein at a location spaced from said coring tool portion along said longitudinal axis to enable access to said chamber to assist in removing cores from said chamber.

12. The tool assembly as recited in claim 10, wherein said first and second end portions of the extension member have a length dimension which is at least three inches so that said first and second end portions of the extension member are each able to move at least three inches into the handle section recess.

13. The tool assembly as recited in claim 12, wherein said dimension of the first and second end portions is at least six inches.

14. A multi-purpose tool assembly adapted to repair golf greens, said tool assembly comprising:

a) a handle section having a handle grip portion and a connecting portion;

b) an elongate operating section comprising a first end portion having a green divot repair portion and a second end portion having a coring tool portion;

c) said operating section having a first operating position in which the second end portion of the operating section is connected to the connecting portion of the handle section and the first end portion of the operating section is spaced from the handle section with its green divot repair portion positioned to perform a green divot repair operation, said operating tool having a second operating position in which the first end portion of the operating section is connected to the connecting portion of the handle section and the second portion of the operating section is spaced from the handle section with the coring tool portion positioned to perform a coring operation;

d) said handle section comprising a cylindrical rolling member which is located so that the handle grip portion is arranged to be able to be positioned with roller member in engagement with a green surface to perform a rolling operation of the green surface.

15. The tool assembly as recited in claim 14, wherein said roller member is configured to comprise at least a portion of the handle section so as to be able to be manually gripped when the tool assembly is in its first or second operating position.

* * * * *